US005482386A

United States Patent [19]

Thiel et al.

[11] Patent Number: 5,482,386

[45] Date of Patent: Jan. 9, 1996

[54] SELECTION CIRCUIT FOR AN ELECTRO-THERMAL PRINTER WITH A RESISTANCE-TYPE RIBBON

[75] Inventors: Wolfgang Thiel; Stephan Günther, both of Berlin, Germany

[73] Assignee: Francotyp-Postalia GmbH, Berlin, Germany

[21] Appl. No.: 82,747

[22] Filed: Jun. 25, 1993

[30] Foreign Application Priority Data

Jun. 26, 1992 [DE] Germany ..... 42 21 275.8

[51] Int. Cl.[6] ..... B41J 2/35

[52] U.S. Cl. ..... 400/120.12; 347/199

[58] Field of Search ..... 400/120, 120.01, 400/120.09, 120.1, 120.11, 120.12; 346/76 PM

[56] References Cited

U.S. PATENT DOCUMENTS

| | | | |
|---|---|---|---|
| 3,744,611 | 7/1973 | Montanari et al. | 400/120.01 |
| 4,350,449 | 9/1982 | Countryman et al. | 400/120 |
| 4,360,819 | 11/1982 | Saito et al. | 400/120 |
| 4,404,567 | 9/1983 | Katsuragi | 400/120 |
| 4,434,356 | 2/1984 | Craig et al. | 400/120 |
| 4,575,731 | 3/1986 | Horlander | 400/120 |
| 4,679,053 | 7/1987 | Katsurai et al. | 400/120 |

FOREIGN PATENT DOCUMENTS

| | | | |
|---|---|---|---|
| 0088156 | 9/1985 | European Pat. Off. | 400/120.01 |
| 0067969 | 8/1988 | European Pat. Off. | 400/120 |
| 0301891 | 2/1989 | European Pat. Off. | 400/120.01 |
| 2100611 | 5/1978 | Germany | 400/120.01 |
| 3139321 | 4/1982 | Germany | 400/120 |
| 3512080 | 10/1985 | Germany | 400/120 |
| 3833746 | 4/1990 | Germany | 400/120.01 |
| 4214545 | 11/1993 | Germany | 400/120.01 |
| 62-46659 | 2/1987 | Japan | 400/120 |
| 63-7952 | 1/1988 | Japan | 400/120 |

OTHER PUBLICATIONS

European Search Report.

*Primary Examiner*—Edgar S. Burr
*Assistant Examiner*—Steven S. Kelley
*Attorney, Agent, or Firm*—Herbert L. Lerner; Laurence A. Greenberg

[57] ABSTRACT

A selection circuit for an electro-thermal printer with a resistance-type ribbon includes a print unit, a current collection electrode, a memory, and a print control unit. The resistance-type inking ribbon that is moved relatively transfers ink particles from an ink layer into areas on a receiving medium when an associated thermal resistance in a resistance layer is heated. A voltage drop that is caused by a total current and by a variance of the resistances is measured through a non-selective current path (feedback layer) in the resistance inking ribbon by a measurement electrode that is disposed close to the print head. That causes a constant voltage source which has a reference voltage input to apply feed voltage to the electrodes that are temporarily connected therewith through a switching unit.

21 Claims, 3 Drawing Sheets

SELECTION CIRCUIT FOR AN ELECTRO-THERMAL PRINTER WITH A RESISTANCE-TYPE RIBBON

SPECIFICATION

The invention relates to a selection circuit for an electro-thermal (ETR) printer having a resistance-type inking ribbon which transfers ink particles to a receiving surface upon being heated, a current collector electrode, a memory, a print control unit that acts upon a switching unit for the ETR print unit, and electrodes of the print head being provided with energy from an energy source for individual pixels of the print image.

Such printing systems, which print a design on a receiving surface to be imprinted that is moved relative to the system, have an ink carrier which likewise moves relative to the system, has a defined electrical resistance and transfers the ink particles, are suitable for franking mail by means of automatic franking systems, as an example.

Automatic franking systems have input, memory and display means as well as a print control unit for a printer. The print control unit includes a microprocessor control and acts upon a switching unit.

From German Published, Non-Prosecuted Application DE 38 33 746 A1, a switching unit acted upon by a selector unit (ASE) is already known for a printing head that, unlike an ETR printing head, itself contains the resistor elements (thermal transfer printing) and has selective control, with preheating of the resistor elements to reduce filament energy consumption during the printing process.

In a first selection phase, a serial/parallel shift register acted upon by the serial printing data sends the printing data on to the latches of a buffer memory. In a second selection phase, each gate selected by the associated outputs of the latches is switched open during one strobe pulse, and one selection pulse is output to the applicable resistor element. The resistor heating elements are preheated directly by a timing-pulse frequency that is adapted in its pulse height and pulse width to the necessary heating energy. Such preheating with energy from a voltage source is already impossible in principle in a printer with an electro-thermal resistance-type inking ribbon (ETR), because its resistor elements are located in the resistance layer of the resistance-type inking ribbon, and because the resistance-type inking ribbon is moved relative both to the printing head and to the receiving surface to be imprinted.

Once such printer having an electro-thermal resistance-type inking ribbon (an ETR printer) is already known from German Published, Non-Prosecuted Application DE 21 00 611 A1, in which pin electrodes are sheathed by a counter electrode. Power supply to the electrodes is provided by applying a voltage potential from a constant voltage source. This type of selection has the advantage of a simple, inexpensive supply of current, but the print resolution is too low, because of the small number of electrodes. If the casing is omitted the number of electrodes in the print bar can be increased. However, that has the disadvantage of a common current collector electrode then being used as the counter electrode; of the individual currents fed simultaneously through n electrodes being added up at one point in a metal return layer in the resistance-type inking ribbon; and of the voltage drop between that point and the current collector electrode, or in other words through the nonselective part of the current path leading through the resistance-type inking ribbon, being defined by the instantaneously selected number of printing electrodes, which leads to undetectable fluctuations in printing capacity and thus to variable printing quality.

A modern ETR printer includes not only the mechanics but also an electronic head control, an ETR printing head with a number of electrodes, and a current collector electrode, which are all connected to an energy supply unit. The growth in the use of thermal printing, particularly for labeling and bar code applications, has increased the demand for printing heads of relatively large printing width (one inch and more) and greater geometric resolution (200 dots per inch and more). That can be achieved only by printing heads having a number of selectively controllable electrodes. Although originally from 25 to 50 electrodes were adequate for the conventional line printer, the number of electrodes in the above applications rises to 150 to 250 each. Since under certain operating conditions (printing a continuous column), all of the electrodes must be supplied with current simultaneously, considerable effort and expense must be undergone for potentially furnishing such an electrical capacity.

Attempts have already been made with additional circuitry provisions to keep the power conversions per electrode approximately constant, despite the aforementioned factors. The printing energy is, for instance, fed as a constant current into each current path for each electrode, to assure a uniform printing quality. That type of selection is optimal from a technical standpoint, but has the disadvantage of very high costs for power supply if the ETR printing head has a great number of electrodes.

Another well-known ETR-printer control is known from U.S. Pat. No. 4,575,731 (Horlander), which shows as a drive circuit an amplifier controllable as a precision constant current source. In order to divide the current front-end resistor of equal resistance are introduced. The external peripheral electrode of the ETR-printhead is used as a measuring electrode for measuring the voltage drop across the non-selectable current path in the ETR-resistance ribbon. To that end a current of 0.5 mA is fed into the measuring electrode. But the voltage measured to control the total current flow is also affected if there are contact problems with the peripheral electrode. In, for example, franking a letter it is possible that contact problems may arise due to localized bumps in the surface of the letter, which may not be preventable. For franking devices, a circuit that is sensitive to drop-outs of the peripheral electrode, is not usable.

The selection circuit for an ETR printer head selection system, in simple and known cases, has a common voltage source and pre-resistances for the electrodes in each current sub-path. The ETR printing head includes a large number of electrodes being insulated from one another, each of which can produce one pixel of the print image. The energy supplied through these electrodes is converted, in the resistance layer region associated with each pixel, into resistance (Joulean) heat that leads to the melting of the ink located in the ink layer in that region and therefore to the imprinting of a dot.

The ETR printing head in that case acts upon the receiving surface, preferably paper, through a resistance-type inking ribbon that is moved along with the receiving surface. The resistance-type inking ribbon has an upper resistance layer that is in contact with the ETR printing head, a middle current return layer, and a lower ink layer that is in contact with the receiving surface (Published European Application No. 88 156 B1).

It is known to incorporate into each selection circuit of an electrode of the head one such series resistor having a resistance which is constant in each case and is considerably above the sum of the resistances of the resistance-type inking ribbon in the current path.

In that respect, such fixed resistors are dominant over variable resistors, which are located along the path of the printing head, ribbon, and return electrode and which relatively reduce the influence of such variances on the overall resistance. The series resistors that are used have the task of keeping the current for the electrodes as constant as possible. That is achieved all the better, the larger that such resistors are relative to the sum of all of the resistances of the actual printing current path (ribbon resistance, resistance of the metal return layer, transient resistances). At present, the series resistors are selected to be approximately 3 to 4 times larger, and naturally that means that only about one-fourth the energy used is used for printing, while the rest is converted into thermal losses.

That kind of version is employed, for instance, in the Hermes 820 printer equipped with an ETR print unit. The additional loss of electrical energy in the series resistors is disadvantageous.

In particular, that loss is no longer supportable and would lead to oversized power units if work is done with high electrical printing capacity and with a relatively large number of electrodes to be selected in parallel. In the case of a printing width of one inch and a resolution of 250 dpi, which meets the requirements for high-quality label printing, 250 electrodes must be selected. The power loss in that case, at $R=300\ \Omega$ and $I=50$ mA, would rise to $P=250(I^2*R)\approx 187$ W. Another problem with 250 activated electrodes, where a total of current of 12.5 A flows in the nonselective part of the resistance-type inking ribbon, is its feedback from the resistance-type inking ribbon through a current collector electrode.

An ETR printer with two return electrodes is known from Published European Application No. 0 301 891 A1. Although that leads to a split in current upon the return of the total current, it still does not improve the total balance of power. In supplying power to the electrodes, care must also be taken to ensure that the energy to be supplied depends on the resistance of each current path associated with a pixel, on the melting temperature of the ink, on the intended contrast of the print image, and on the speed of the moving resistance-type inking ribbon, and does not rise linearly with the surface roughness of the receiving surface (grade or type of paper).

It is decisive for the printing quality in the ETR method that the electrical power which is converted into heat energy per electrode in the resistance-type inking ribbon be equal for all of the electrodes and at all times.

An overly low electrical power leads to inadequate heating of the applicable pixel region in the layer of ink of the resistance-type inking ribbon. That results in a lesser volume of melted ink and finally in inadequate contrast of the corresponding pixel on the substrate to be imprinted. On the other hand, an overly high electrical power leads to pronounced heating of the ETR ribbon, which also applies to the supporting layer of the ribbon and reduces its strength. If the electrical power is persistently too high, that also leads to an overload on the power supply component unit. In any case, differences in contrast of the print image would become visible if the electrical capacity varies.

Essential factors for a variance in the electrical printing capacity are accordingly as follows:

a) The transient resistance $R_k$ between an electrode of the printing head and the resistance layer of the ETR ribbon, which is dependent above all on the contact pressure prevailing at that moment. However, because of the surface characteristics of the receiving surface, that contact pressure is also affected by the condition of the printing head in terms of wear.

b) The thermal resistance $R_h$ of the resistance layer of the resistance-type inking ribbon, which is dependent on the thickness tolerance and homogeneity of the resistance layer.

c) The resistance $R_r$ of the return metal layer of the resistance-type inking ribbon, which depends on the homogeneity and thickness tolerance of the metal layer of the ribbon and on the distance between the current collector electrode and the printing head electrodes.

d) The integral transient resistance of the resistance layer of the ribbon in the return of the current (ribbon resistance) $R_b$, which is dependent on its thickness tolerance and on the homogeneity of the resistance layer and of the contact surface having the current collector electrode.

e) The integral transient resistance $R_u$ of the resistance layer opposite the current collector electrode, which depends above all on the contact pressure prevailing at that moment. That pressure is affected by the angle of contact between the ribbon and the current collector electrode and by the prevailing tensile forces on the ribbon.

Since very many parasitic series resistances of variable value (transient resistances between electrode and ribbon, return resistance of the aluminum layer in the ribbon, transient resistance between the ribbon and the return electrode) occur in the overall system including the ETR head with the electrodes, the ETR ribbon, and the return electrode, and they lead to a variation in the total resistance during operation, it is impossible to dispense with the series resistors if the principle of a constant voltage source is to be preserved, because the partial voltage, which would then likewise vary, above the heating (=printing) resistor would lead to varying printing energies. The result would be fluctuating print qualities.

The primary influence on the fluctuation in the voltage drop arises not only from the above factors but also from imprinting variable data. In general, a number between 0 and n of the existing electrodes is selected per printed column. The voltage drop across the resistances c) through e) located in the nonselective (return) current path is dependent on the current flowing through them. That current, in turn, is equal to the sum of individual currents in the selective portion of the current path having the resistances a)+b) and thus depends on the number of selected electrodes of the printing head.

In German Published, Non-Prosecuted Application DE 42 14 545.7 A1, a configuration for ETR printing head control, with a memory, and with microprocessor control for an ETR print unit, has already been proposed in order to improve the print quality while simultaneously reducing the power loss, and energy for the electrodes of the ETR print unit is furnished from a controllable energy source.

In that version, the number of electrodes that are temporarily connected to the controllable energy source is specified by the microprocessor control, which outputs a control signal corresponding to the dependency on the number of selected electrodes to the controllable energy source. The electrodes that are temporarily connected through a switching unit are acted upon by the controllable energy source with a current or a voltage having a magnitude which exhibits a dependency on the temporarily varying number of selected electrodes, in such a way that a larger number of electrodes is supplied with a higher current or voltage than is a smaller number. A regulating voltage, preferably generated through a D/A converter, is carried to an amplifier input of an amplifier, which outputs the required nominal voltage for the controllable voltage source. With a current collector electrode, the total current flowing in the resistance-type inking ribbon is conducted to ground.

In a variant having a controllable voltage source, the total current also flows through an external measuring resistor, at which a calibrating voltage is picked up or tapped off and delivered to a second input of the amplifier. However, that combination of control and regulation is expensive in terms of circuitry. At a higher (lower) calibrating voltage, the nominal voltage and thus the feed voltage of the printing head is reduced (increased). Thus, however, only the fluctuations in the total resistance that are dictated by the ribbon quality can be compensated for, but no errors can be detected. At higher total resistance, the calibrating voltage decreases, and particularly to compensate for contact problems of the electrodes, the feed voltage is increased. However, the failure of one electrode cannot be detected. The calibrating voltage then drops, and the other electrodes are supplied with a somewhat overly high feed voltage, which causes a somewhat greater contrast in the print image. On the other hand, an increase in the total current caused by an error in the printing head control circuit would lead to an insignificant reduction in the feed voltage and therefore in the contrast and would initially remain unnoticed. However, in long-term operation it can lead to serious damage in the equipment.

The invention takes as its point of departure the fact that for a higher number n of existing electrodes to be selected simultaneously, feeding the individual electrodes through the control circuit of the prior art is too expensive and too complicated.

It is accordingly an object of the invention to provide a selection circuit for an electro-thermal printer with a resistance-type ribbon, which overcomes the hereinafore-mentioned disadvantages of the heretofore-known devices of this general type and which does so using a less-expensive power supply. The circuit configuration should be usable for high performance ETR printers with a number of electrodes, with a drastic reduction in the power loss and no loss in printing quality. Protection of the printer from destruction should also be assured.

With the foregoing and other objects in view there is provided, in accordance with the invention, in an electro-thermal printer including an ETR print unit having a print head with electrodes, a current collector electrode, a switching unit connected to the ETR print unit, a print control unit connected to the switching unit, a memory connected to the print control unit, and a resistance-type inking ribbon being heated for transferring ink particles to a receiving medium to form a print image having pixels, a selection circuit for the electro-thermal printer, comprising an energy source in the form of a constant voltage source supplying energy to the electrodes of the print head for the individual pixels of the print image, the constant voltage source having an input for a reference voltage to compensate an existing variance in a voltage drop across heating resistances in the resistive ink ribbon, the electrodes temporarily receiving a feed voltage from the constant voltage source through the switching unit and being acted upon by a regulated feed voltage equal to a sum of a defined adjustable print voltage corresponding to a voltage dropping across a selective part of a current path and the reference voltage formed from a voltage drop measured across an unselective section of the current path in the resistance-type inking ribbon, the feed voltage for the activated electrodes of the print head having a level being regulated for keeping the print voltage constant, and an increase or decrease in the measurement voltage leads to a respective increase or reduction in the feed voltage.

Taking the total resistance into account, the invention is based on the concept of creating a cost-effective alternative to the version with a control system for the feed voltage, as has been proposed in German Published, Non-Prosecuted Application DE 42 14 545.7 A1, with a regulation of the feed voltage to suit the constantly varying power requirement.

In order to provide a joint power supply to the electrodes, an adjustable constant-voltage source is used which outputs a feed voltage with respect to chassis potential, including a constant adjustable printing voltage, that is increased by a variable reference voltage.

The reference voltage with respect to chassis potential is variable as a function of the number n of simultaneously activated electrodes and of the variance of certain resistances in the resistance-type inking ribbon. The point of departure for the invention is the fact that this enables compensating for the incident variance in the voltage drop across the heating resistances in the resistance-type inking ribbon.

According to the invention, the voltage drop across the nonselective (return) current path in the resistance-type inking ribbon, caused by the total current, is measured by means of one or more additional or existing electrodes that are disposed on the printing head. This measured value forms the reference voltage, preferably at the same level. It is added to the set printing voltage. The feed voltage of the activated electrodes of the printing head is then obtained, in such a way that a rise in the measured value leads to an increase, and a drop therein leads to a decrease, in the feed voltage, while the print voltage remains constant.

In the case of a level of the reference voltage that is reduced as compared with the measured voltage, the level of the feed voltage on one hand has a dependency on the temporarily different number n of activated electrodes in such a way that a larger number of activated electrodes is supplied with a higher feed voltage, but with a reduced print energy per dot, than a lesser number of activated electrodes, which at a lower feed voltage are supplied with a higher printing energy per dot.

Moreover, the variance in the resistances in the nonselective (return) current path in the resistance-type inking ribbon is also taken into account at the same time.

The measurement electrode is a separately disposed printing head electrode and/or a normal printing head electrode that is not activated at that moment. Advantageously, the ETR printing head can be equipped with peripheral electrodes for that purpose, which are each located at the ends of the printing head electrodes disposed in a line in the print bar, but that are not used for the imprint of the postage.

Other features which are considered as characteristic for the invention are set forth in the appended claims.

Although the invention is illustrated and described herein as embodied in a selection circuit for an electro-thermal printer with a resistance-type ribbon, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
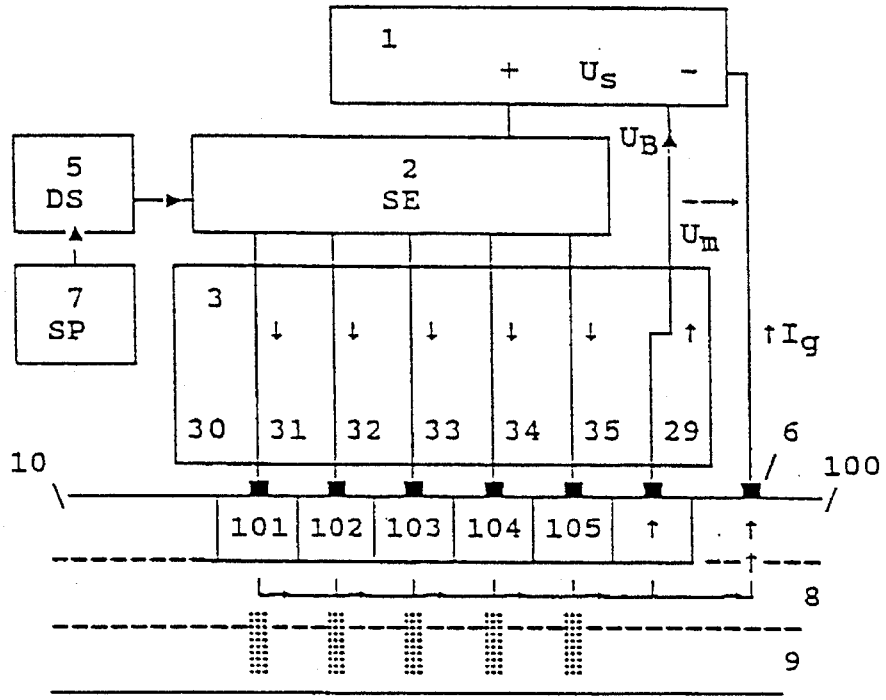
FIG. 1 is a block circuit diagram of an electro-thermal printer according to the invention.

Referring now to the figures of the drawing in detail and first, particularly, to FIG. 1 thereof, there is seen a block circuit diagram of an electro-thermal printer according to the invention, with a control circuit that includes a constant voltage source 1, a switching unit 2, an ETR print unit 3, a print control unit 5, and a current collector electrode 6, and a memory 7 that is connected to the print control unit 5 for controlling the ETR print unit 3. The memory 7 contains at least the graphic data for one print image.

The print control unit (DS) 5 of the control circuit acts upon the switching unit 2. In order to control a print head 30, the electrodes are furnished with energy from the controllable constant voltage source 1 in a manner defined for the individual pixels of the print image, and a printed design is imprinted on a receiving surface to be imprinted, which is moved relative to it. A resistive ink ribbon 10, which is likewise moved relatively, transfers ink particles from an ink layer 9 to zones 101, 102, 103, . . . , upon heating of an associated heating resistance in a resistance layer 100. The switching unit 2 that is acted upon through the print control unit 5 transmits an output to the ETR print head 30 of the ETR print unit 3. The print head is in contact with the ETR resistive ink ribbon 10 through electrodes 31, 32, 33, . . . . The relevant printing information at a given time is loaded at a correspondingly appropriate time $t_1$ into the switching unit 2, which in the activated state, from a time $t_2$, assures that the pixels to be imprinted will be supplied with current for a defined time period $t_j$, so that the heat required for the printing process will be generated in the briefly selected electrically contacted zones 101, 102, . . . , 105, . . . of the resistance layer 100 of the resistive ink ribbon 10.

Energy for the electrodes of the ETR print unit 3 is furnished from the adjustable constant voltage source 1. The particular electrodes 31, 32, 33, . . . that are temporarily connected to the controllable voltage source 1 are specified by the print control unit 5. In FIG. 1, the electrodes 31, 32, 33, 34 and 35 are connected to the constant voltage source 1 through the switching unit 2 by a positive pole $+U_s$. Each partial current effects heating in the respective electrically contacted zones of the resistance layer 100.

The current collects in a return layer 8, which is preferably formed of aluminum, and which has a current return resistor $R_r$, that is not shown in FIG. 1. The current flows through the resistance layer 100 to the current collector electrode 6 that is connected to ground (or to the negative pole $-U_s$) and in so doing generates a voltage drop. This voltage drop can be picked up with a measurement electrode 29.

Through the use of at least one electrode 29 disposed near the print head, the voltage drop across the nonselective (return) current path in the resistance-type inking ribbon, which is brought about by the total current $I_g$ and by the variance in the resistances, is measured and causes the constant voltage source 1 to impose a feed voltage $U_s$ upon g the electrodes 31, 32, 33, . . . that are temporarily connected with it through the switching unit 2. The level of the feed voltage of the activated electrodes of the print head is controlled in such a way that a rise in the measured value leads to an increase in the feed voltage to the electrodes, and a drop leads to a lowering of the feed voltage. A compensation for the existing variance in the voltage drop across the heating resistances and the resistance-type inking ribbon is carried out by these means.

The constant voltage source 1 has a reference voltage input for the measured voltage output by at least one measurement electrode. This voltage is dependent on the number n of selected electrodes and on the residual resistance $R_r$. At least one additional print head electrode, which is present for production reasons but is unused in printing, can advantageously be used for the measurement electrode 29.

Figure 2:
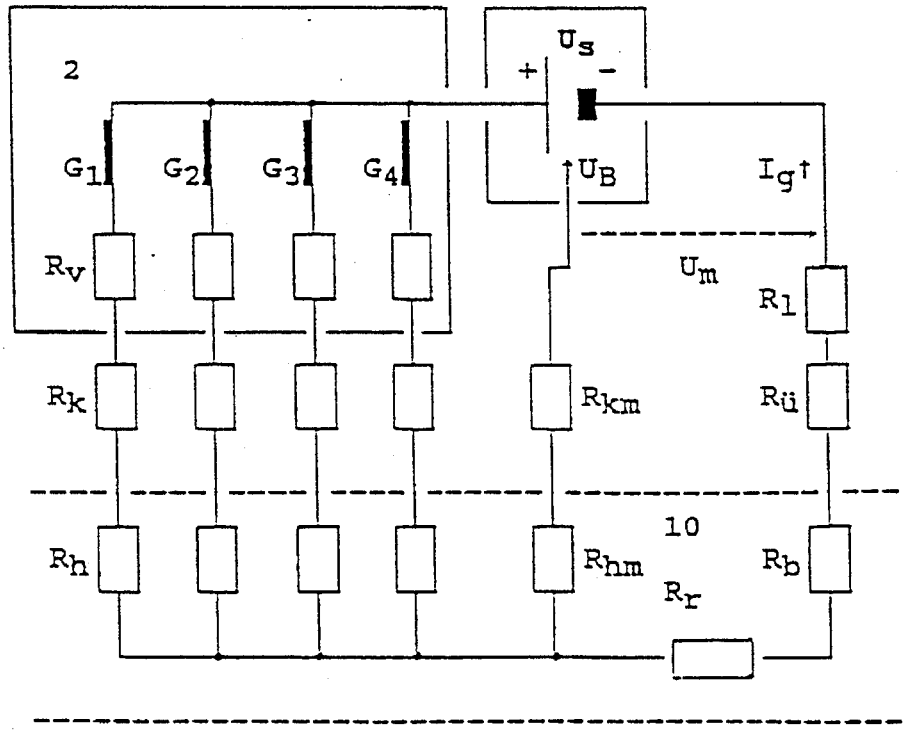
FIG. 2 is an equivalent block circuit diagram of a control circuit with a single constant power source.

FIG. 2 shows a equivalent circuit diagram with a constant voltage source having one input for a reference voltage $U_b$, and showing the switching unit 2. For the sake of simplicity, FIG. 2 shows only gates $G_1$ through $G_4$ of the switching unit 2, in the form of switches with associated pre-resistors $R_v$. The switches are shown in the closed state during a current flow time $t_j$, or in other words when a strobe pulse is present at the switching unit.

In order to provide a constant print quality, the printer drive is adjusted in such a way that for each ribbon speed $V_{bj}$, where j=1, 2, . . . , m, the following equation applies:

$$t_j * V_{bj} = c, \text{ where } c = \text{constant} \quad (1)$$

The equivalent circuit diagram for ETR printers shows four turned-on current paths with associated resistors $R_{p1}$, $R_{p2}$, $R_{p3}$ and $R_{p4}$ and with a residual resistor $R_{rest}$, a measurement current path, and a constant voltage source $U_s$. Each resistor $R_{pi}$ is a sum of resistances, as follows:

$$R_{pi} = R_{vi} + R_{ki} + R_{hi} \quad (2)$$

where i=1, 2, 3, 4, for the various current paths.

The common residual resistance is as follows:

$$R_{rest} = R_r + R_b + {}_u + R_1 \quad (3)$$

where

R=pre-resistance $R_k$=contact resistance of an electrode $R_h$=resistance heating element $R_r$=current return resistance $R_b$=ribbon resistance $R_u$=ribbon/return electrode transient resistance $R_1$=line resistance The resistance of the pre-resistances $R_v$ and $R_k$ is substantially less than that of the heating resistances $R_h$. The resistive heating elements $R_h \approx R_p$ are controlled by a timing-pulse frequency that is adapted, in its pulse height and pulse width, to the necessary heat energy. As a result, the energy $W_p$ that determines the print quality, in each resistive heating element $R_h$, becomes as follows:

$$W_r=(U_r^2/R_h)*t_j, \text{ where } R_h>>R_v+R_k \quad (4)$$

The requisite pulse height $U_p$ is furnished by the adjustable constant voltage source 1, which for that purpose acts upon the electrodes 31, 32, 33, . . . that are temporarily connected with it through the switching unit 2 with the voltage $U_s$, the level of which has a dependency on the temporarily varying number n of controlled electrodes in such a way that a larger number of electrodes is supplied with a higher current or with a higher voltage than a smaller number.

The following equation applies approximately to the total current:

$$I_g=(I_{p1}+I_{p2}+\ldots I_{pi})=n*I_p \quad (5)$$

The total resistance $R_g$ becomes:

$$R_g=(R_{p1}\|R_{p2}\|R_{p3}\|\ldots\|R_{pi})+R_{rest} \quad (6)$$

where in simplified terms, if $R_{p1}=R_{p2}=R_{p3}=\ldots=R_{pi}$ and i=n, then $$R_g=(R_p/n)+R_{rest} \quad (7)$$

The value of the pre-resistance $R_v$ is 1/10 to 1/100 of the resistance of the effective heating resistance $R_h$. As compared with the aforementioned prior art, this still further minimizes the system losses. In the pre-resistance, where if $R_v$=1.2 Ω (or $R_v$=15 Ω), approximately 3 mW (or 37.4 mW, respectively) are lost in the form of heat, since $I_p$=50 mA when n equals only one electrode. If n=192 as the number of simultaneously activated electrodes, one entire column of print is printed, and to compensate for the resultant additional increase in contrast, only 40 mA should then continue to flow per electrode. In the pre-resistances, a total of approximately 0.6 W (or 4.6 W, respectively), are thus converted into heat. The residual resistance $R_{rest}\approx 1$ Ω, by comparison, is power-loss-intensive at a high number of simultaneously selected electrodes (approximately 90 to 100 W if n=192). If $R_{rest}<<R_p$ and if only a single electrode is selected, the losses are minimal (approximately 50 mW if n=1).

In the case of the measurement voltage $U_m$, the following equation applies, given a negligibly low current flow in the measurement current circuit:

$$U_m=n*I*(R_r+R_u+R_1) \quad (8)$$

It was found that the measured voltage $U_m$, because of the unavoidable resistances $R_{km}$=5 Ω and $R_{hm}$=115 Ω in the measuring current circuit, is falsified by only 4.8 mV at a measured current of 40 A.

From this measured voltage, the reference potential for the constant voltage source 1 is formed, preferably by impedance conversion. The electrodes are acted upon by a feed voltage $U_s$ equal to the sum of the reference voltage $U_b$ and a voltage $U_p$ that is adjustable by a defined factor α:

$$U_s \alpha U_p+U_p \quad (9)$$

A variant embodiment of the control circuit will be explained below in conjunction with FIG. 3.

In the case of the switching unit 2, for instance for selecting 192 electrodes in one print bar, six SN 75518 control circuits can advantageously be used, each with 32 bit shift registers, 32 latches in the intermediate memory, and 32 AND gates. The "data out" output of the first control circuit is respectively connected to the "data in" input of the second control circuit. The inputs and outputs are connected in the same way in the following circuits in order to load all of the printing data for one printed column. After a defined period of time elapses, the new printing data are furnished by the print control unit 5 and can be stored in the latches of the intermediate memory.

Every serial/parallel shift register of the switching unit 2 that is acted upon with the serial printing data directly at the "data in" input transfers the printing data, in a first control phase from time $t_1$, to the latches of an associated intermediate memory, which has a "latch enable" control input. In other words, the current printing information is available in the switching unit 2 for an adequately long time prior to the actual printing process. In a second control phase, from time $t_2$, every gate $G_1$, $G_2$, . . . of a driver on the output side is switched open or to throughput, with each gate being triggered during a strobe pulse by the associated outputs of the latches, and a selection pulse with the pulse width $t_j$ is transmitted to the applicable current path with the associated resistances $R_p$ and $R_{Rest}$.

In the control circuit on which the exemplary embodiment is based, the best printing results are attainable with an electrode current of approximately 45 to 50 mA. For the preferred number of electrodes used, that is n=192 electrodes, and for the ribbon type being used, this is equivalent to a thermal resistance $R_h$ of approximately 120 Ω and an output of approximately 300 mW converted into heat in each heating resistance.

If the 192 electrodes are selected simultaneously, and the residual resistance $R_{Rest}$ is approximately 1 Ω, a measurement voltage $U_m$ of a maximum of 10 V is measured, and a feed voltage $U_s$ of approximately 19 V is therefore needed. A voltage of only approximately 1 V then drops across the pre-resistances $R_v$ between the driver output of the switching unit 2 and the electrodes, which have a resistance of between one-eighth and one-hundredth the resistance of the heating resistor $R_h$ in the resistance layer 100 of the resistance-type inking ribbon 10.

Figure 3:
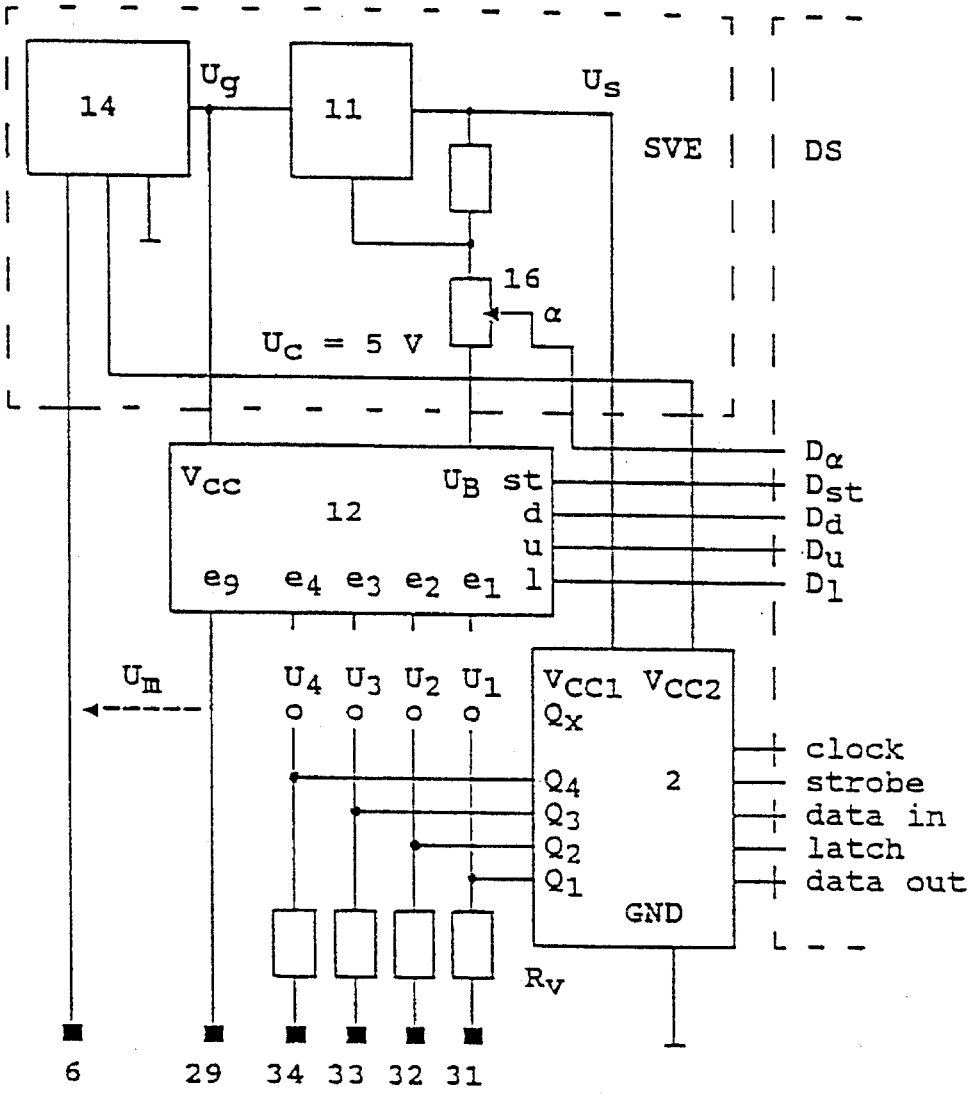
FIG. 3 is a block circuit diagram of a variant embodiment of the control circuit of the electro-thermal printer.
Figure 6:
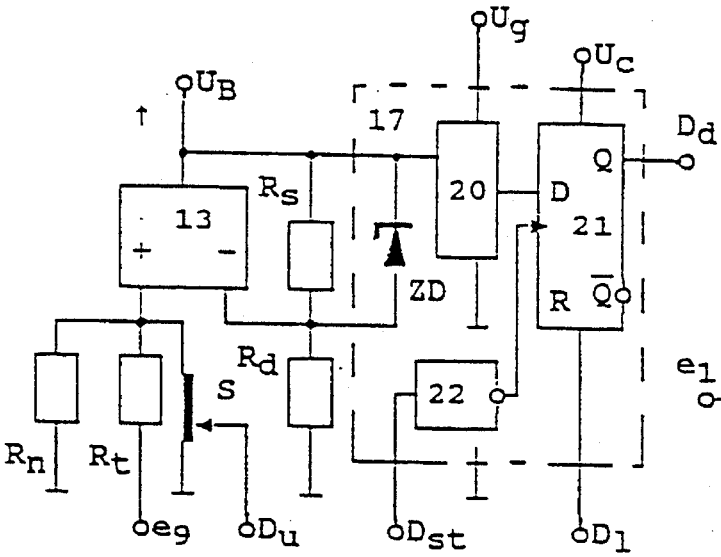
FIG. 6 is a block circuit diagram of a first variant of a matching circuit.

In FIG. 3, a voltage supply unit SVE which is again presented has an adjustable constant voltage source 11 and a power supply unit 14, which outputs a first direct current voltage $U_g$ of a maximum of 30 V and a second direct current voltage $U_c$=+5 V for supplying the remainder of the circuit, and in particular the switching unit 2. The adjustable constant voltage source is a linear regulator 11, in particular, which by way of example includes a parallel circuit of the circuit type LM 317, to which the first DC voltage $U_g$ is supplied and which outputs a voltage $U_s$ that has been regulated on the output side, for feeding the drivers in the switching unit 2. The reference voltage $U_B$ at the control input of the linear regulator 11 is obtained directly from the analogous measured voltage $U_m$, or indirectly from the amplified measured voltage through a matching circuit 12. The matching circuit 12 includes at least one non-inverting amplifier 13, connected as a voltage follower, for impedance conversion, and one safety or protective circuit 17 for protecting against an overly high output, which are seen in FIG. 6. It includes a Zener diode, which limits the reference voltage to $U_b$<+10 V.

Figure 4:
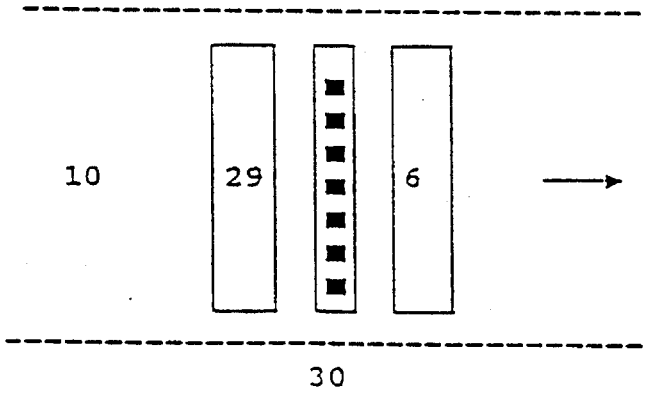
FIG. 4 is an elevational view of a variant of the printer with a separately disposed measurement electrode.

FIG. 4 relates to a further variant, with an extra flat or planar measurement electrode 29 on one side of the print bar, and with the current collector electrode 6 disposed on the other side.

Figure 5:
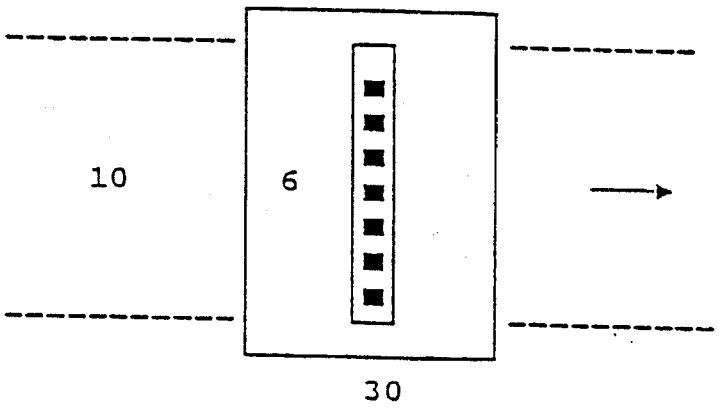
FIG. 5 is an elevational view of a variant of the printer with a measurement electrode in the print bar and with a large-area current collector electrode.

In a preferred variant which is shown in FIG. 5, the measurement electrodes are each disposed on the two ends of the print bar of the print head 30, spaced apart from the printing electrodes. The peripheral electrodes are likewise in contact with the resistance-type inking ribbon, but are not acted upon by selection pulses from the print head control electronics. The current collector electrode 6 surrounds the print rail in planar fashion a short distance away from it, and preferably includes a piece of sheet metal with a central opening in the form of a recess for the print head 30.

The measured voltage is picked up virtually without output, since the non-inverting amplifier 13 shown in FIG. 6 is integrated into the measurement branch, as follows:

$$U_B=(R_n/R_d),*\ [(R_d+R_s)/(R_i+R_n)]*U_m \quad (10)$$

The resistance ratio makes it possible to adjust the basic amplification. The amplification is theoretically 1, but can also assume other values by means of the external wiring of the amplifier, should that be necessary for improved print quality. Due to the cooler environment or surroundings of the printed dot or print point, when only a single dot is printed more energy is needed than when an entire printed column is printed. For n=192 simultaneously activated electrodes, a current of only approximately $I_p$=40 mA is then needed to compensate for the resultant increase in contrast, which is dictated by reciprocal heating of adjacent electrodes.

It has been found that the total energy required for printing a column, in which all of the print electrodes are acted upon simultaneously, is approximately 80% of the printing energy per dot. In order to provide an amplification $V_u$<1 which is adjusted in a defined manner, the feed voltage $U_s$, which is divided between the print voltage $U_p$ and the measurement voltage $U_m$, and correspondingly the simultaneously selected number n of electrodes are automatically reduced. For example, for n=192, $U_m$ is reduced from 10 V to a lesser value, and as a result a lower total current $I_g$ flows through the total resistance $R_g$, and $U_m$ drops further until a stable m state is attained. The voltage across the heating resistance then attains a lower limit value.

By dimensioning the amplifier circuit, the current that flows toward ground across the measurement electrodes and the current return circuit is adjusted far below the threshold value above which the measured current would cause an additional printed pixel (dot). The safety or protective circuit 17 includes a Zener diode that limits the reference voltage $U_b$<+10 V and is preferably connected parallel to the negative feedback or counter coupling resistor $R_s$. The protective circuit 17 is intended to prevent the destruction of the print head in the case of an error, and to that end it cooperates with the print control unit (DS) and with a circuit element S.

One or more measuring devices 18, 19 and/or 20 may be used. A measuring device includes at least one Schmitt trigger, a comparator or a threshold value switch, which can be interrogated by the print control unit 5 in order to interrupt printing operation as needed and issue an error report. The reference voltage is then adjusted to $U_b$=0 V with the circuit element S.

The linear regulator 11 shown in FIG. 3 has a device 16 for adjusting the print voltage $U_p$. This presupposes that the device 16 is an adjusting resistor.

In another variant, the device 16 for adjusting the print voltage $U_p$ is an adjusting element, which can be electronically triggered through the line $D_\alpha$ of the print control unit 5 and with which an adjusting value α is adjusted as a function of the material forming the receiving surface or recording medium being used, and in particular the grade or type of paper, for a particular ribbon speed $V_{bj}$.

It is additionally provided that the current flow time $t_j$ assigned to a defined ribbon speed $V_{bj}$ is preset to achieve the desired contrast in the print image by the print control unit 5 through the strobe pulse duration $t_j$.

In the error situation, if none of the measurement electrodes is in contact with the resistance-type inking ribbon 10, or if the reference voltage $U_b$ is at overly high values for the number n of simultaneously selected electrodes, then the adjusting device or element 16 is controlled by the print control unit 5 to a lower control value α, so that the print voltage adjusts to a harmless value of $\alpha U_p \approx 1$ V.

The other error situation, if the reference voltage $U_b$ is at overly low values, is evaluated by a second measurement device 19, which can likewise be interrogated by the print control unit 5. The measurement device 19 again has one threshold value switch and a comparator or Schmitt trigger. Preferably, the threshold value of each measurement device 18, 19, 20 will be set to suit a defined number n of electrodes to be activated simultaneously.

An error report is issued by the print control unit 5 whenever a location suitable for evaluation is printed in the print image and the suitably set threshold value fails to be attained or is exceeded.

It is also provided that the safety or protective circuit 17 has a Zener diode ZD and a window comparator 20 that can be interrogated by the print control unit 5, the output of which comparator is present at the D input of a intermediate memory 21. The measurement takes place at the end of the transient effect, since the signal $D_{st}$ that initiated the measurement is connected, through a delay circuit 22 for the strobe pulse, to the clock or pulse input of an intermediate memory 21, which can be acted upon through $D_1$ with a reset or set-back pulse (latch enable) and has a data output $D_d$ that leads to the print control unit 5.

An advantageous variant of the matching circuit shown in FIG. 6 has as its measurement device 20 at least one window comparator that can be interrogated by the print control unit 5 and has an output which is located at a D input of a D flip-flop 21. A signal $D_{st}$ corresponding to a strobe pulse is present at a delay circuit 22, and the output is connected to a clock or pulse input of the D flip-flop 21, which can be acted upon with a reset or set-back pulse by a signal $D_1$ corresponding to a latch enable and has a data output $D_d$.

The print control unit 5 evaluates the signal at the data output $D_d$ and outputs control signals to the control circuit. Upon a signal $D_u$ for interrupting printing operation, the measurement voltage $U_m$ and thus the reference voltage $U_b$ can be set to $U_b$=0 V using a circuit element S. The print voltage $U_p$ is reduced in addition.

Figure 7:
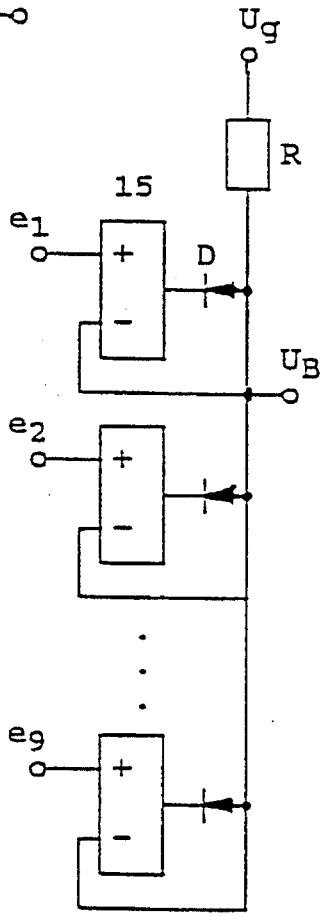
FIG. 7 is a block circuit diagram of a second variant of the matching circuit.

In a further variant of the embodiment of the invention shown in FIG. 7, the electrodes of the print head 30 that have not yet been selected are used as measurement electrodes, along with the measurement electrode 29, for measurement. At outputs $Q_1$ through $Q_x$ of the switching unit 2, all or some of voltages $U_1$ to $U_4$ are tapped off and applied respectively to inputs $e_1$ through $e_4$, and the voltage $U_m$ taped off up at the measurement electrode 29 is applied to an input $e_9$ of the matching circuit 12. The matching circuit 12 has a circuit for evaluating a plurality of direct voltages to find the lowest direct voltage. This circuit includes a corresponding number of non-inverting operational amplifiers 15, each with one diode D connected to its output side. Each diode D is connected by its n-doped region to the amplifier output and by its p-doped region to the inverting input (–) of the amplifier 15, directly (voltage follower) or through a voltage divider, which is not shown in FIG. 7, in order to form the reference voltage $U_B=V_u*U_m$.

A safety or protective circuit 17 is likewise located at the output, although it is not shown in FIG. 7. The protective or safety circuit 17 likewise includes a Zener diode, a measurement device 18, 19 or 20, a intermediate memory 21, and a pulse delay circuit 22, as was already explained for FIG. 6.

This type or method of controlling the print head with the aid of an adjustable constant voltage source 11 has the advantage that, with the aid of at least one non-activated print head electrode, a voltage drop $U_m$ in the resistive ink ribbon is measured during the ETR printing or postage imprinting process. That compensation for the variance in the voltage drop $U_p$ existing because of the aforementioned factors in the resistance-type inking ribbon 10 can be carried out by means of the feed voltage $U_s$ furnished for the activate print electrodes by the constant voltage source 11. To assure the functional capability and high print quality, an evaluation and suitable control can be carried out by means of the print control unit 5.

The invention is not restricted to the present form of embodiment. On the contrary, a number of variants that make use of the version shown, even with fundamentally differently constructed features, is conceivable.

We claim:

1. In an electro-thermal printer including an ETR print unit having a print head with temporarily activated electrodes, a current collector electrode, a switching unit connected to the ETR print unit, a print control unit connected to the switching unit, a memory connected to the print control unit, and a resistance-type inking ribbon being heated for transferring ink particles to a receiving medium to form a print image having pixels, an energy source for supplying energy to the temporarily activated electrodes forming the pixels, the energy source comprising:

a constant voltage source having an input for receiving a measured reference voltage, measured as a voltage drop in a non-selective part of a current path formed by the resistance-type ink ribbon; means to preset the constant voltage source to an adjustable constant voltage, the measured voltage is added to the voltage of the constant voltage source, means providing a supply voltage to energize the temporarily activated electrodes, said supply voltage being equal to the sum of the adjustable constant voltage and the measured reference voltage.

2. The selection circuit according to claim 1, wherein at least one of the electrodes disposed at least close to the print head is a nonactivated measurement electrode contacting the resistance-type inking ribbon, the measured voltage is a voltage drop being caused by a total current and by a variance in resistances across the nonselective (feedback) current path in the resistance-type inking ribbon and being measured by the measurement electrode, the switching unit has pre-resistances, and during a time in which current flows, the electrodes temporarily receiving the feed voltage from said constant voltage source through the switching unit and the pre-resistances are acted upon by a voltage having a level being dependent on the temporarily varying number of activated electrodes for supplying a larger number of activated electrodes with a higher voltage than a smaller number.

3. The selection circuit according to claim 2, including a voltage supply unit having said constant voltage source, a power unit supplying a first DC voltage and a second DC voltage for powering the switching unit;

the switching unit having a driver;

said constant voltage source being a linear regulator receiving the first DC voltage, having an output side supplying the feed voltage for feeding the driver in the switching unit and having a control input; and a matching circuit being connected between the control input of said linear regulator and said measurement electrode, for forming the reference voltage from the analog measured voltage.

4. The selection circuit according to claim 3, wherein at a level of the reference voltage being reduced relative to the measured voltage, the level of the feed voltage has a dependency on the temporarily varying number of activated electrodes, for supplying a larger number of simultaneously activated electrodes with a higher feed voltage but with a reduced printing energy per dot than a lesser number of simultaneously activated electrodes being supplied with a higher print energy per dot at a reduced feed voltage.

5. The selection circuit according to claim 3, wherein said linear regulator has a device for adjusting the print voltage.

6. The selection circuit according to claim 5, wherein said device is a trimmer resistor.

7. The selection circuit according to claim 5, wherein the device for adjusting the print voltage is an adjusting element being electronically controlled by the print control unit, said adjusting element setting an adjusting value through lines as a function of the material of the recording medium, and in particular the type of paper, for a predetermined ribbon speed.

8. The selection circuit according to claim 2, wherein the current flow time assigned to a predetermined ribbon speed is preset by the print control unit in accordance with a desired contrast in the print image.

9. The selection circuit according to claim 1, including an extra planar measurement electrode disposed on one side of a print bar, the current collector electrode being connected to chassis potential and disposed on the other side of the print bar.

10. The selection circuit according to claim 2, wherein said current collector electrode is a single large-area current collector electrode having an opening formed therein for the print head and the measurement electrode.

11. The selection circuit according to claim 3, wherein the switching unit has outputs; said matching circuit has inputs; the print electrodes of the print head that are not activated at a given time are used as measurement electrodes along with said measurement electrode, for measurement purposes; at least one sub-set voltage is tapped off at the outputs of the switching unit and applied respectively to the inputs of said matching circuit; the voltage tapped off at the measurement electrode is applied to one of the inputs of said matching circuit; and said matching circuit has a circuit for evaluating a plurality of DC voltages to find a lowest DC voltage.

12. The selection circuit according to claim 4, wherein said matching circuit has at least one non-inverting operational amplifier with adjustable voltage amplification.

13. The selection circuit according to claim 12, wherein said non-inverting operational amplifier is connected as a voltage follower or has a voltage amplification=1.

14. The selection circuit according to claim 11, wherein said circuit of said matching circuit for evaluating a plurality of DC voltages to find the lowest DC voltage includes a corresponding number of non-inverting operational amplifiers having inverting inputs and outputs, and diodes each being connected to the output of a respective one of said non-inverting operational amplifiers, each of said diodes having an n-doped region connected to the output of said respective non-inverting operational amplifier and a p-doped region connected to the inverting input of the said respective non-inverting operational amplifier directly, or through a voltage divider.

15. The selection circuit according to claim 1, wherein the resistance-type inking ribbon has a resistance layer with a heating resistance, and the switching unit has a driver output and pre-resistances between the driver output and the electrodes having a resistance of between one-eighth and one-hundredth the value of the heating resistance.

16. The selection circuit according to claim 3, wherein said matching circuit has at least one amplifier with an output and includes a safety circuit connected to the amplifier output, said safety circuit having a Zener diode and a measurement device having at least one Schmitt trigger, a comparator, and at least one of a threshold value switch and a window comparator to be interrogated by the print control unit, as needed to interrupt a printing operation and issue an error report.

17. The selection circuit according to claim 3, wherein said matching circuit has at least one amplifier with an output and includes a safety circuit connected to the amplifier output, said safety circuit having a Zener diode, a measurement device and an intermediate memory to be interrogated by the print control unit for interrupting a printing operation as needed and issuing an error report.

18. The selection circuit according to claim 17, including a D-flip-flop to be acted upon with a reset pulse through a signal corresponding to latch enable, said D-flip-flop having a data output, a D input and a pulse input, said measurement device having at least one window comparator to be interrogated by the print control unit, said window comparator having an output connected to the D input of said D-flip-flop, a delay circuit receiving a signal corresponding to a strobe pulse and an output connected to the pulse input of said D-flip-flop.

19. The selection circuit according to claim 18, including a circuit element connected to chassis potential and to a non-inverting input of said at least one amplifier, said circuit element adjusting the measured voltage and the reference voltage until the reference voltage=0 V upon a signal for interrupting the printing operation.

20. The selection circuit according to claim 19, wherein said linear regulator has an adjusting element being electronically controlled by the print control unit for adjusting the print voltage, said adjusting element sets an adjusting value through lines as a function of the material of the recording medium, for a predetermined ribbon speed, and the adjusting value is changed if printing operation is interrupted.

21. In an electro-thermal printer including an ETR print unit having a print head with electrodes, a current collector electrode, a switching unit connected to the ETR print unit, a print control unit connected to the switching unit, a memory connected to the print control unit, and a resistance-type inking ribbon being heated for transferring ink particles to a receiving medium to form a print image having pixels, a selection circuit for the electro-thermal printer, comprising:

an energy source in the form of a constant voltage source supplying energy to the electrodes of the print head for the individual pixels of the print image, said constant voltage source having an input for a reference voltage to compensate an existing variance in a voltage drop across heating resistances in the resistive ink ribbon, the electrodes temporarily receiving a feed voltage from said constant voltage source through the switching unit and being acted upon by a regulated feed voltage equal to a sum of a defined adjustable print voltage corresponding to a voltage dropping across a selective part of a current path and the reference voltage formed from a voltage drop measured across an unselective section of the current path in the resistance-type inking ribbon, the feed voltage for the activated electrodes of the print head having a level and means to regulate said level for keeping the print voltage constant, and means responsive to an increase or decrease in the measured voltage to increase or reduce the feed voltage.

* * * * *